US010736446B2

(12) United States Patent
Sasuga et al.

(10) Patent No.: US 10,736,446 B2
(45) Date of Patent: Aug. 11, 2020

(54) BEVERAGE GLASS RIM COATING ARTICLE AND METHOD

(71) Applicant: San Diego Farms LLC, Chicago, IL (US)

(72) Inventors: David Sasuga, Vista, CA (US); John Michael Freitas, Carlsbad, CA (US); Ju Won Park, San Marcos, CA (US)

(73) Assignee: San Diego Farms LLC, Chicago, IL (US)

( * ) Notice: Subject to any disclaimer, the term of this patent is extended or adjusted under 35 U.S.C. 154(b) by 45 days.

(21) Appl. No.: 15/904,117

(22) Filed: Feb. 23, 2018

(65) Prior Publication Data

US 2019/0261796 A1 Aug. 29, 2019

(51) Int. Cl.

| | |
|---|---|
| ***A47G 19/30*** | (2006.01) |
| ***A47G 19/22*** | (2006.01) |
| ***B05C 19/00*** | (2006.01) |

(52) U.S. Cl.

CPC ..... *A47G 19/30* (2013.01); *A47G 19/22* (2013.01); *A47G 19/2205* (2013.01); *B05C 19/008* (2013.01); *A47G 2400/06* (2013.01)

(58) Field of Classification Search

CPC ..... A47J 31/40; A47J 31/41; B65D 25/04; B65D 21/0233; B65D 5/5286; B65D 5/5293; B65D 1/36; A47G 19/30; A47G 19/2205; A47G 2400/06; A47G 19/22; A47G 19/23; A23G 19/34; A47B 71/00; A47B 69/00; A47B 75/00; A23P 20/12; A23L 2/38; B05C 19/008; B05C 11/11; B05C 9/10; B05C 9/12; B05C 3/09; B05C 3/20

USPC ..... 118/13; 220/505, 507, 553, 555; D7/553.4, 553.5, 554.3, 555, 546, 357, D7/590, 596, 701, 549, 601, 368; D9/428

See application file for complete search history.

(56) References Cited

U.S. PATENT DOCUMENTS

| | | | | |
|---|---|---|---|---|
| 3,223,127 | A * | 12/1965 | Sidebottom | A47L 19/02 141/364 |
| 3,327,682 | A | 6/1967 | Garay et al. | |
| 3,450,096 | A * | 6/1969 | Lancette | A47G 19/22 118/16 |
| D505,833 | S * | 6/2005 | Ahearn | D7/549 |
| 2003/0185943 | A1 * | 10/2003 | Bradley | B65D 1/36 426/115 |
| 2004/0206302 | A1 | 10/2004 | Propp | |
| 2005/0191398 | A1 * | 9/2005 | Duffy, III | C12G 3/04 426/592 |
| 2005/0214418 | A1 | 9/2005 | Radow | |

(Continued)

OTHER PUBLICATIONS

English Abstract of TW390120, Chen (Oct. 11, 2010). (Year: 2010).*

*Primary Examiner* — Laura Edwards

(74) *Attorney, Agent, or Firm* — Charles F. Reidelbach, Jr.

(57) ABSTRACT

An article for treating the rim of a beverage glass includes a tray, an edible liquid substance, an edible particulate substance, and a cover. The sheet has an upper surface with a plurality of recesses extending downwardly from the upper surface. The edible liquid substance and the edible particulate substances are separately disposed in different recesses. The cover is assembled to the upper surface to retain the edible substances within the recesses.

18 Claims, 5 Drawing Sheets

(56) References Cited

U.S. PATENT DOCUMENTS

| | | | | |
|---|---|---|---|---|
| 2012/0114867 | A1* | 5/2012 | Quinn | A47G 19/00<br>427/430.1 |
| 2012/0219685 | A1* | 8/2012 | Radow | A47G 19/00<br>426/420 |

* cited by examiner

BEVERAGE GLASS RIM COATING ARTICLE AND METHOD

FIELD OF THE INVENTION

The present disclosure concerns an efficient and convenient way for applying coatings and flavorings to a beverage glass rim.

BACKGROUND

For certain beverages there is a desire to apply an edible coating to a rim of a beverage glass. In the context of this patent application, a beverage "glass" can be formed from various materials including glass, metal, plastic, or a combination thereof. Coating the rim may include adhering an annular ring of edible particles to the rim. Examples of edible particles include sugar crystals, salt crystals, and other particulate based edible substances. Other possible edible particulate substances can include one or more of seeds, flakes, vitamin powder, crushed candy canes, cheese, and bacon bits, to name a few examples. There is a desire to improve the convenience and efficiency of applying such a coating.

BRIEF DESCRIPTION OF THE FIGURES

FIG. 3A is a side cross section view depicting an embodiment of an article for coating a rim of a drinking glass before removing a cover.

FIG. 3B is a side cross section view depicting an embodiment of an article for coating a rim of a drinking glass during use. FIG. 3B also depicts the rim of a wide drinking glass being coated with an annular coating of an edible liquid substance.

FIG. 3C is similar to FIG. 3B except depicting the rim being coated with an annular coating of an edible particulate substance.

FIG. 3D is similar to FIG. 3B except that a narrow glass rim is being coated with an edible liquid substance.

FIG. 3E is similar to FIG. 3C except that a narrow glass rim is being coated with an edible particulate substance.

BRIEF DESCRIPTION OF THE FIGURES

Figure 1:
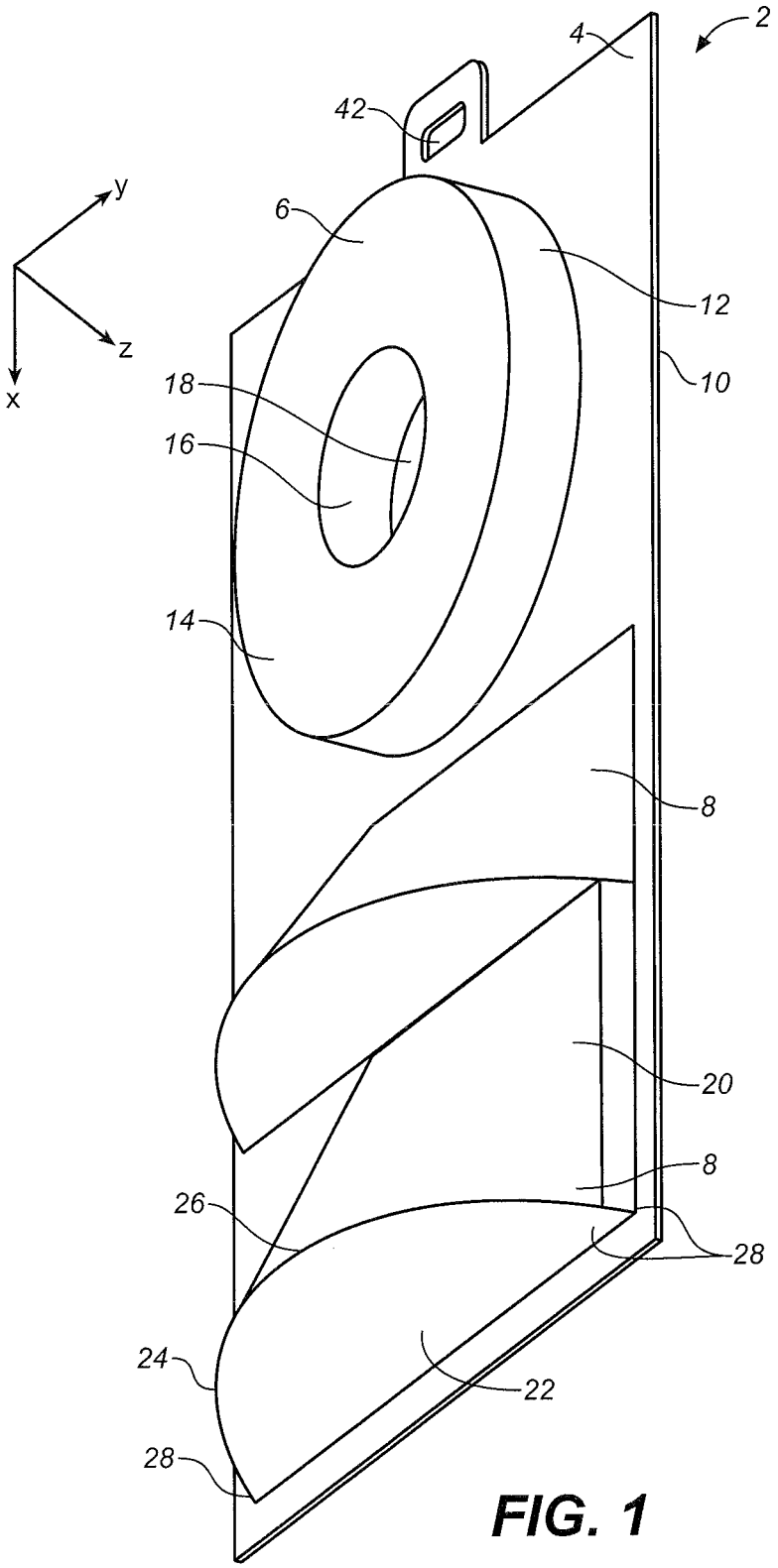
FIG. 1 is an isometric drawing depicting an embodiment of an article for coating a rim of a drinking glass.

In a first aspect of the disclosure, an article for treating the rim of a beverage glass includes a tray, an edible liquid substance, an edible particulate substance, and a cover. The tray has an upper surface with a plurality of recesses extending downwardly from the upper surface. The edible liquid substance and the edible particulate substances are separately disposed in different recesses. The cover is assembled to the upper surface to retain the edible substances within the recesses.

In one implementation one of the recesses is defined by at least two intersecting surfaces including a sloped surface and a steep surface. The sloped surface slopes obliquely downwardly from the upper surface and can be a curved surface or can define a shape of a truncated cylinder, a truncated cone, a truncated ellipse, or another curved surface. The steep surface slopes at or nearly a right angle from the upper surface and can define the shape of a truncated conic section such as a truncated circle or a truncated ellipse. The intersection between the sloped surface and the steep surface define an arcuate curve. The arcuate curve is optimized for a typical rim of a drinking glass. The recess can be shaped like a trench. The arcuate curve can have an apex that defines the lowest extent of the trench. The arcuate curve can include two legs that intersect or are proximate to the upper surface at opposed ends of the article with respect to an intermediate axis of the article.

In another implementation the article includes features for providing multiple functions including supporting the article in a retail setting, storing the edible substances, and for facilitating coating of the rim with the edible substances. The features can include a feature for hanging the tray from a hook with the upper surface disposed substantially vertically with respect to a gravitational reference. The feature can be one or more of an opening or a hook formed at one end or edge of the tray.

In yet another implementation the plurality of recesses can be arranged along a major axis of the tray. The recesses can include an annular recess and two trench-shaped or sloped recesses. The annular recess can be bounded vertically between the upper surface and a flat bottom of the recess. The annular recess can be bonded horizontally between two concentric cylindrical walls. The trench shaped recess can be defined by two intersecting surfaces including a sloped surface and a steep surface. The two types of recesses functionally enable the coating of two different drinking glasses including a wide drinking glass and a narrow drinking glass.

In a further implementation the tray is formed from a polymer sheet. The polymer sheet can be injection molded, blow molded, or heat formed to define the recesses. The cover can be a polymer film that is thinner than the polymer sheet. The polymer film can be attached and sealed to the upper surface. Attachment and sealing can be accomplished with heat and pressure such as with heat staking or heat sealing.

In yet further implementations the edible substances can be dispensed directly into the recesses or can be contained in sealed bags which are then loaded into recesses. The edible liquid substance can be one or more of a syrup, honey, agave, maple syrup, and balsamic syrup to name a few examples. The edible particulate substance can be water soluble crystals such as sugar crystals or salt crystals. Other examples of edible particulate substances can include cookie crumbs, seeds, flakes, vitamin powder, crushed candy canes, cheese bits, and bacon bits to name more examples.

DETAILED DESCRIPTION OF THE PREFERRED EMBODIMENTS

FIGS. 1, 2, and 3A-E describe an embodiment of an article 2 according to the present disclosure for coating a rim of a drinking glass. In describing article 2, mutually perpendicular axes X, Y, and Z will be utilized. Axes X and Y will be referred to as lateral axes and axis Z will be referred to as a vertical axis. Axis X corresponds to a major axis of article 2. Axis Y is an intermediate axis and axis Z is a minor axis. Vertical axis Z is generally aligned with a gravitational axis when the article 2 is being used to coat a rim of a drinking glass with +Z being in an upward direction. However, the axis X can be aligned with a gravitational axis when the article is being displayed or hung in a retail store. A "display configuration" can be defined to include the X axis substantially aligned with the gravitational reference. A "rimming" configuration (during which the rim of a glass is treated with liquid and particulates as will be described) can be defined to include the Z-axis substantially aligned with the gravitational reference.

Article 2 includes a tray 4 which defines a plurality of recesses. In the illustrated embodiment, the plurality of recesses include an annular recess 6 and two inclined or trench-shaped recesses 8 (8A and 8B in later figures) that extend downwardly from an upper surface 10. The recesses are arranged along major axis X.

The annular recess 6 is defined by an outer vertical cylindrical wall 12, a flat annular surface 14, an inner vertical cylindrical wall 16, and an inner circular surface 18. The annular recess 6 is defined between the outer 16 and inner 18 cylindrical walls and between the upper surface 10 and the flat annular surface 14.

An inclined recess 8 is defined by two intersecting surfaces including a sloped surface 20 and a steep or vertical surface 22. The sloped surface 20 can define an acute angle with respect to the upper surface 10. The sloped surface 20 can be a curved surface defining a curved shape such as a truncated conical surface, a truncated cylindrical surface, or a truncated elliptical surface to name some examples. The steep surface 22 can define a right angle or nearly a right angle with respect to the upper surface 10. The steep surface 22 can define a shape of a truncated conic section such as a truncated circular shape or a truncated oval shape. The intersection 24 between the scoped surface 20 and the steep surface 22 can define an arcuate curve 24. The arcuate curve 24 has an apex 26 that defines the lowest or deepest extent of the inclined recess 8. The arcuate curve also has two legs or ends 28 that are proximate to or intersect the upper surface 10.

Figure 2:
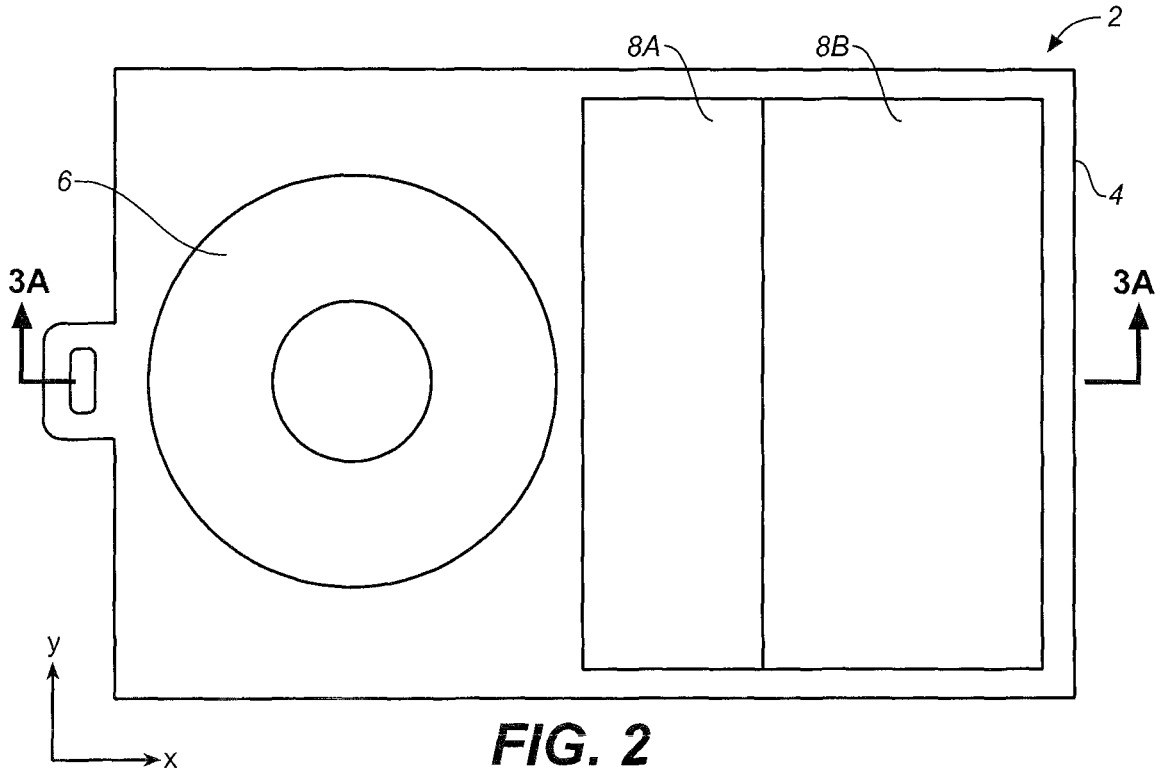
FIG. 2 is a top view depicting an embodiment of an article for coating a rim of a drinking glass. Subsequent

FIG. 2 depicts a plan view of article 2. FIGS. 3A-E are cross sectional views taken from section FIG. 2 along section 3A-3A. The cross sectional views vary in terms of the state and/or use of the article 2.

Figure 3A:
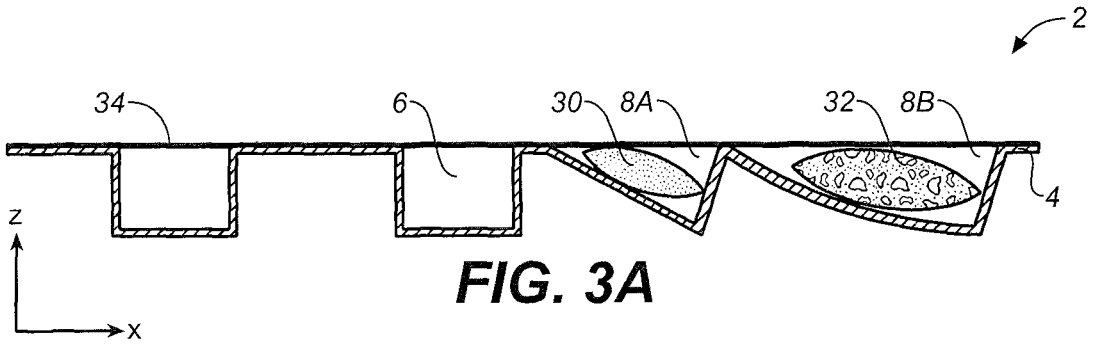
FIGS. 3A-E are taken from section 3A of FIG. 2.

FIG. 3A depicts a sectional view of an embodiment of an article 2 before use. Disposed in one or more of the recesses is a bag of edible liquid substance 30 and a bag of edible particles 32. In the illustrated embodiment the edible substances 30 and 32 are disposed in the two inclined recesses 8A and 8B respectively.

The bags are secured into the recesses by a cover 34 that is attached to the tray 4. In one embodiment the tray 4 is a relatively thicker material compared to the cover 34. In one embodiment the tray 4 is a thick plastic film and cover 34 is a thin plastic film.

In an alternative embodiment, the edible liquid substance 30 can be directly dispensed into the recess 8A without being encased in a bag. The edible particulate substance 32 can be directly dispensed into recesses 6 and 8B without using a bag. In yet other embodiments, a bag may be employed just for the edible liquid substance 30 but not for the edible particulate substance 32. In some embodiments, the edible particulate substance 32 can be placed as a loose powder in recesses 6 and 8B to allow for coating glasses having varying rim diameters.

In a further embodiment, the tray 4 can be provided with just the edible liquid substance 30 or just the edible particulate substance 32. In yet other embodiments, the tray 4 can be provided empty. If the tray 4 is empty it can be provided without a cover 34. One advantage of providing empty trays 4 without covers 34 is that they can be stored in a nested configuration whereby they are stacked, one on top of the other, in the Z-direction. Then the user of the trays would provide the edible liquid substance 30 and the edible particulate substance 32 as required.

The particular shapes of the sloped recesses 8A and 8B are optimized for coating efficiency and minimizing waste of material. The sloped recess 8A has a linear cross sectional profile along X and occupies a smaller lateral distance along lateral axis X. The sloped recess 8B occupies a larger lateral distance along lateral axis X and include a curved or arcuate cross sectional profile along the section 3A. Stated another way, the sloped surface 20 defines a varying angle relative to the upper surface 10 that decreases with depth. This provides a greater capacity for the edible particulate substance 32.

Figure 3B:
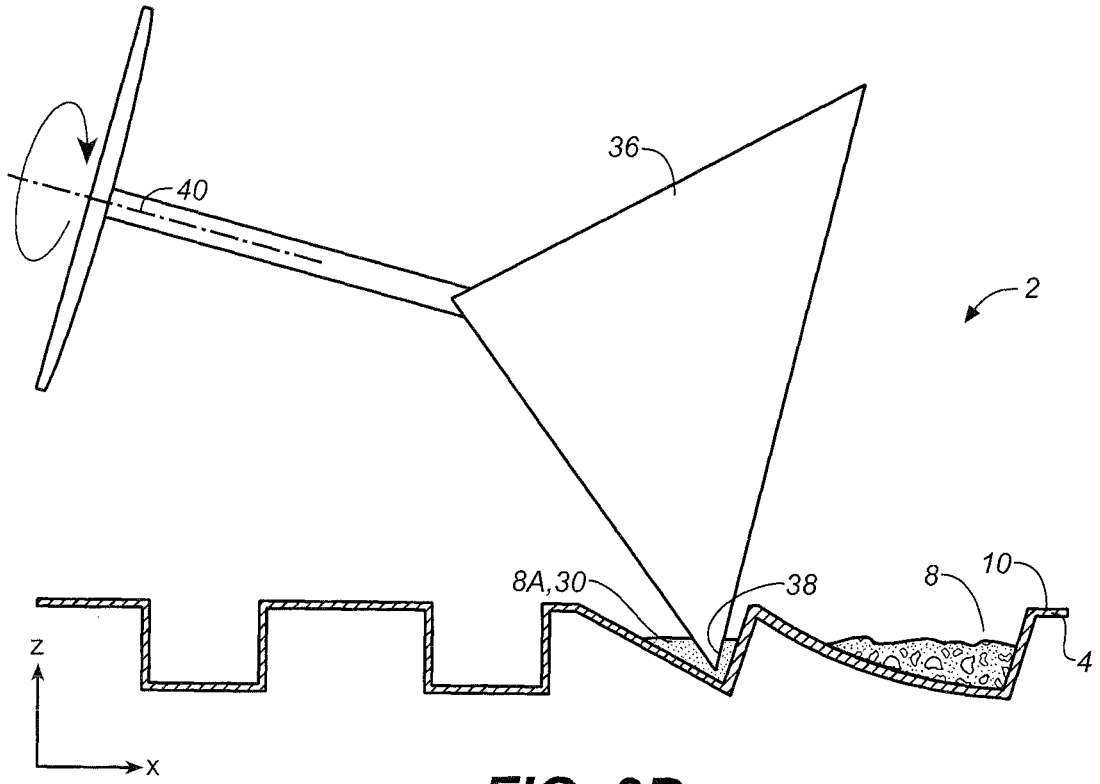
Figure 3C:
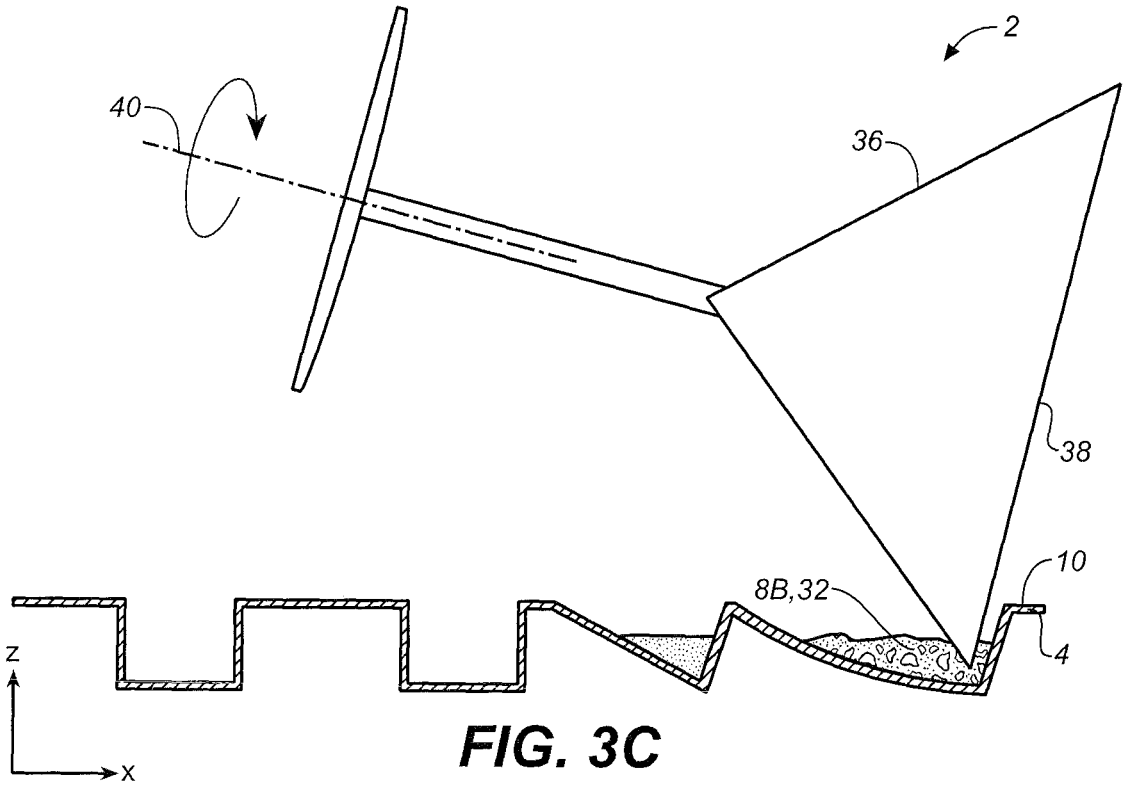

FIG. 3B depicts a sectional view of the article 2 in use (with the cover 34 having been removed) for coating a rim of a wide drinking glass 36 with the edible liquid substance 30. The drinking glass 36 is positioned whereby an arcuate portion of rim 38 is within the inclined recess 8A. The drinking glass 36 has a central axis 40 that is inclined at an oblique angle with respect to the lateral upper surface 10. In the illustrated embodiment, the oblique angle is an acute angle in a range of about 30 to 60 degrees or about 45 degrees although other angles may be suitable. The drinking glass 36 is being rotated about the central axis 40 in order to coat the rim 38 with an annular coating of the edible liquid substance 30. FIG. 3C is similar to FIG. 3B except that the rim 38 is being coated with the edible particulate substance 32.

Figure 3D:
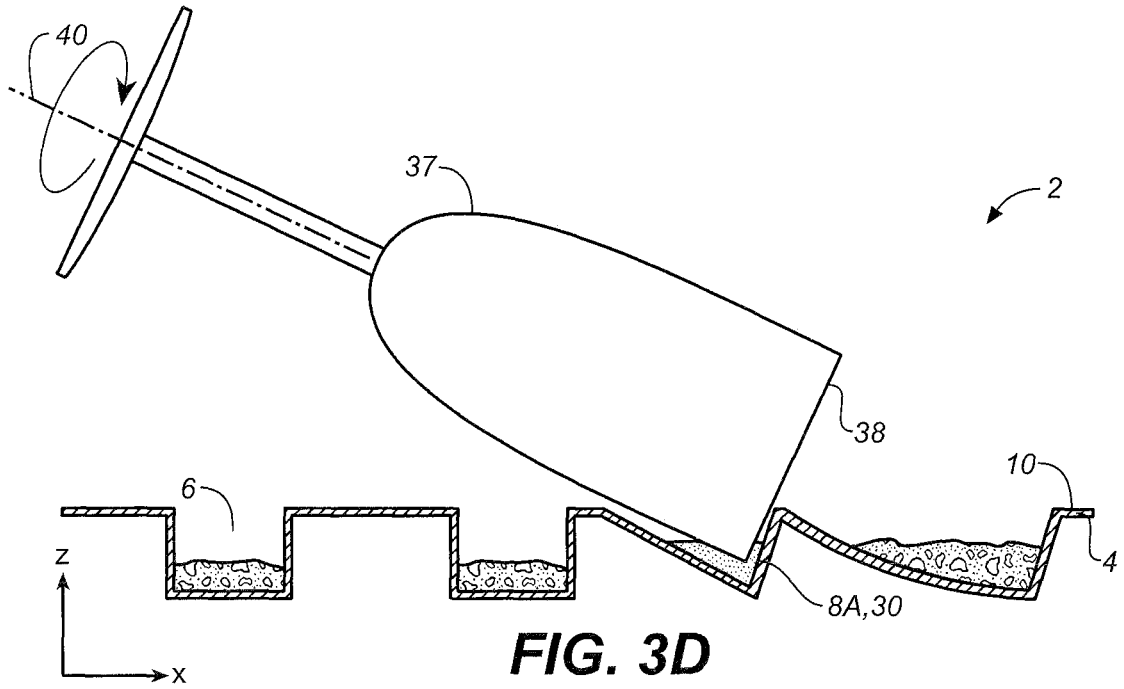
Figure 3E:
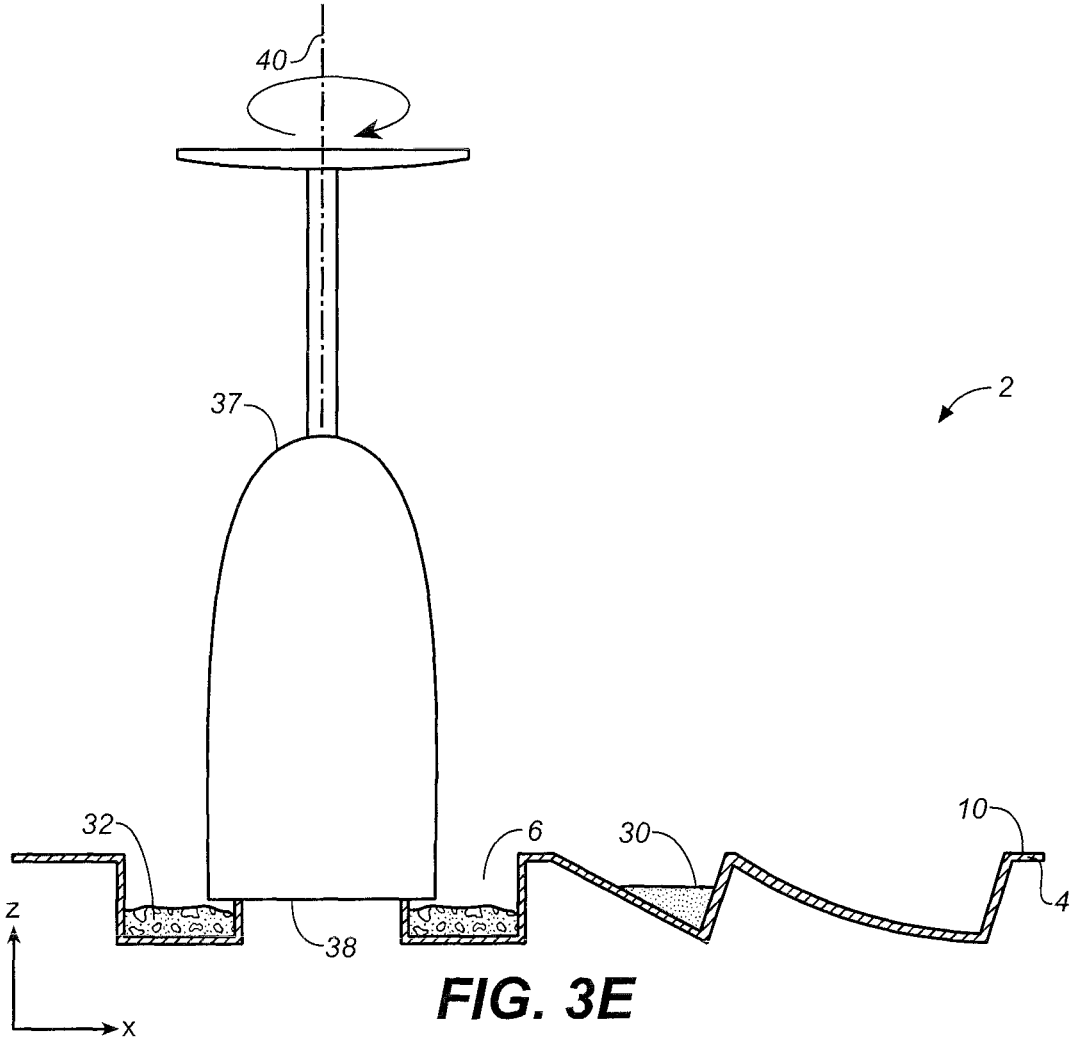

FIG. 3D is a sectional view of the article 2 in use for coating a narrow rim drinking glass 37 with the edible liquid. The coating method is essentially the same as for the wide rim glass 36. FIG. 3E depicts the rim 38 being coated with the edible particulate substance 32 using the annular recess 6. In FIG. 3E, the central axis 40 defines essentially a right angle with respect to the upper surface 10 and is generally aligned with a gravitational reference. It may not be necessary to rotate the glass; just touching the rim 38 to the edible particulate substance 32 may provide a sufficient annular coating.

As depicted in FIGS. 3B-E, the design of tray 4 functionally enables the coating of two different drinking glasses including the wide drinking glass 36 and the narrow drinking glass 37. Tray 4 allows coating of drinking glasses 36 that could otherwise not be coated using an annular recess 6 having a limited diameter defined by the cylindrical surface 12.

Figure 4:
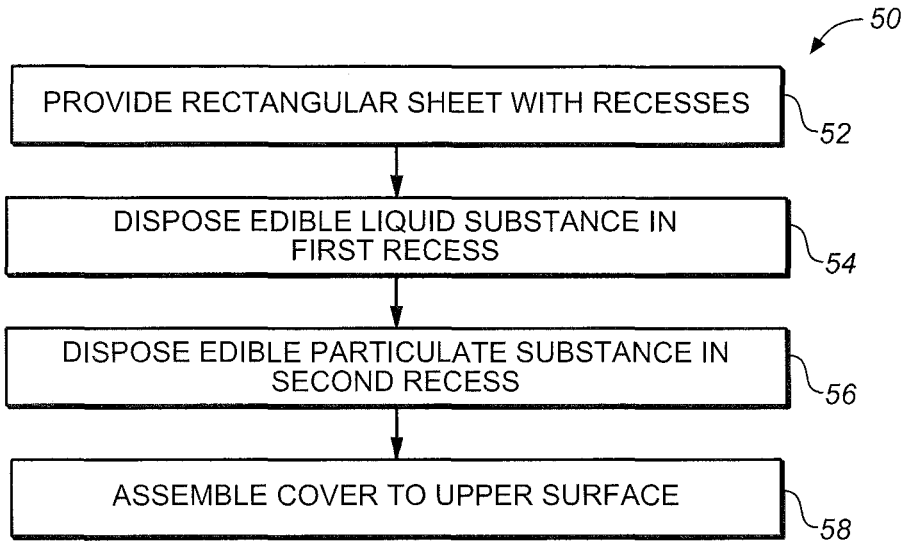
FIG. 4 is a flowchart depicting an embodiment of a method of manufacturing an article for coating a rim of a drinking glass.

FIG. 4 is a flowchart depicting an embodiment of a method 50 of manufacturing the article 2. According to step 52, a rectangular tray 4 with recesses is fabricated.

In one embodiment of step 52 the tray 4 is a rectangular sheet formed from a polymeric roll or sheet of thermoplastic material which is feed through a sequence of operations. In the first operation the polymeric roll material is passed through a hot press tool that applies heat and pressure to define the recesses 6 and 8. In a second operation the polymeric roll material is passed through a punch that at defines at least one opening 42 (FIG. 1) for hanging the article 2 in a retail store. In a third operation the material passes through a die cutting operation that cuts out the formed sheet 4. In a fourth operation the formed sheet is picked up and placed in a magazine stack. In a particular embodiment, the recesses overlay each other and allow for nested stacking of a plurality of trays 4.

In another embodiment of step 52 the rectangular sheet 4 can be formed by a compression molding process. In yet another embodiment of step 52 the rectangular sheet can be formed with an injection molding process. In a further embodiment of step 52 two rectangular sheets can be manufactured at the same time using a blow molding operation. Other embodiments for forming tray 4 are possible.

In step 54 the edible liquid substance 30 is placed or dispensed into one of the recesses. In an illustrated embodiment, the a bag containing the edible liquid substance 30 is placed in a first one of the inclined recesses 8. In step 56 the edible particulate substance 32 is placed or dispensed into one of the recesses. In an illustrated embodiment, a bag 32 containing the edible particulate substance 32 is placed into a second one of the recesses. In a particular embodiment, one or more bags are formed via a process of using heat sealed rectangular sheets that enclose the contents. In another illustrative embodiment, a bag with the edible liquid substance 30 is placed into a first recess 8A and the edible particulate substance 32 is directly placed into two other recesses 6 and 8B without being contained in a bag.

In step 58 the cover 34 is assembled to the surface 10 to retain the edible substances 30 and 32. In an illustrative embodiment, the cover 34 is a film that is heat staked or thermally sealed to the surface 10.

Figure 5:
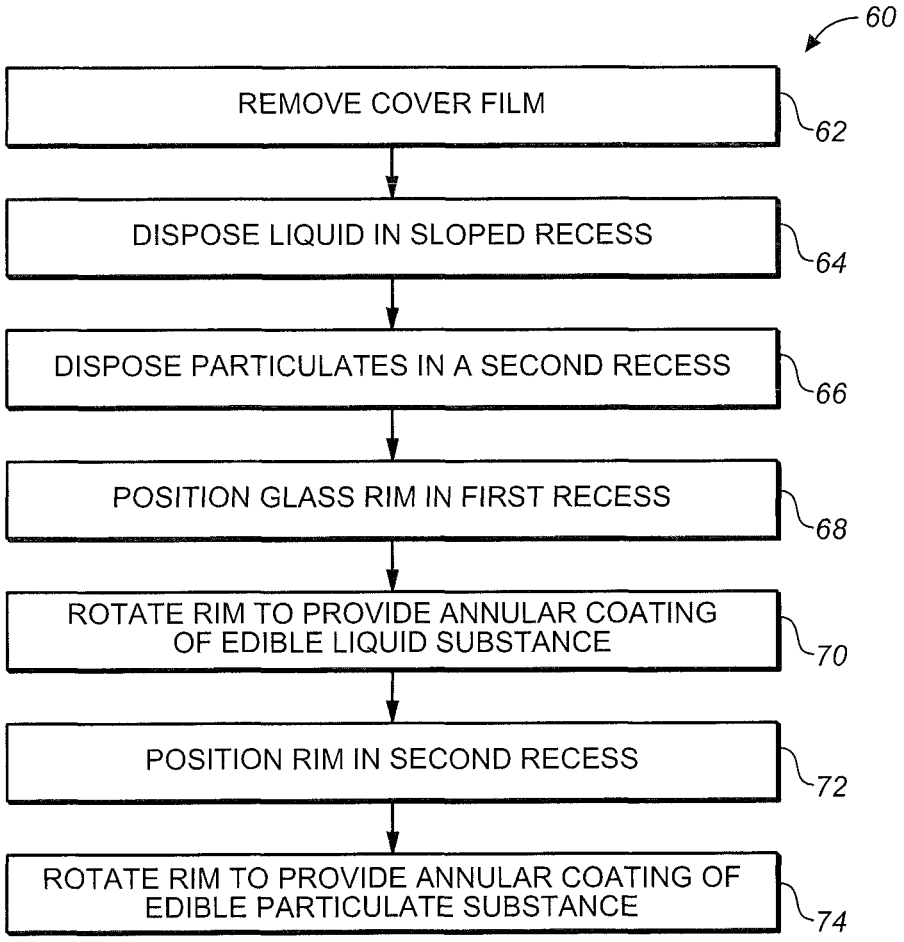
FIG. 5 is a flowchart depicting an embodiment of a method of coating a rim of a drinking glass with an annular coating of an edible particulate substance.

FIG. 5 is a flowchart depicting an embodiment of a method 60 for using article 2 for coating the rim 38 of a drinking glass 36 or 37. See FIGS. 3A-E. According to step 62, the cover 34 is removed from tray 4 when the tray 4 is in an orientation as illustrated in FIG. 3A. In one embodiment removing the cover 34 refers to peeling film 34 from sheet 4.

According to step 64, the edible liquid substance 30 is disposed in a first of the sloped recesses 8A. In one embodiment this includes opening a bag containing the edible liquid substance 30. According to step 66, the edible particulate substance is disposed in one or both of the recesses 6 and 8B.

According to step 68, the drinking glass 36 is positioned whereby at least a portion of the rim 38 is positioned in a recess containing the edible liquid substance 30. According to the embodiment illustrated in FIG. 3B, a central axis of the 40 of the drinking glass 36 defines an oblique angle with respect to axes X, Y, and Z and a portion of the rim 38 is positioned proximate to the arcuate curve 24 and within the syrup contained in the recess 8A. According to step 70, the drinking glass is rotated about the central axis 40 to provide an annular coating of edible liquid 30 upon the rim 38.

According to step 72, the drinking glass 36 is positioned whereby at least a portion of the rim 38 is positioned in a recess containing the edible particulate substance 32. In a first embodiment of step 72, the positioning illustrated in FIG. 3C. In a second embodiment of step 72, the rim 38 is positioned in the annular recess 6 so that the rim is in contact with edible particles 32 that line the flat annular surface 14 as illustrated in FIG. 3D.

According to step 74, the rim 38 is rotated about the central axis 40 whereby a coating of edible particles 32 adhere to the annular coating of syrup from step 70. This results in an annular coating of an edible particulate substance 32 that is adhered to the rim 38 by the syrup. In the embodiment of FIG. 3E, just placement of the rim into the edible particulate substance 32 may be sufficient with minimal or no rotation of the glass 37.

The specific embodiments and applications thereof described above are for illustrative purposes only and do not preclude modifications and variations encompassed by the scope of the following claims.

What is claimed:

1. An article for treating a rim of a beverage glass comprising:

a tray defining an upper surface with a plurality of recesses extending downwardly from the upper surface, the plurality of recesses including at least a first recess and a second recess;

the first recess having an annular recess with a generally planar bottom for accommodating a beverage glass rim having a rim diameter to fit within the annular recess when treating the rim;

the second recess is defined by two sloped surfaces that intersect along an arcuate curve, the two sloped surfaces individually define an acute angle with respect to the upper surface, the arcuate curve has an apex defining a lowest extent of the recess and two legs that intersect the upper surface;

the second recess to accommodate an edge portion of a beverage glass having a widened rim diameter that is too large to fit within the annular recess when treating the widened rim;

an edible substance disposed in at least one of the plurality of the recesses;

and a cover assembled to the upper surface to retain the edible substance within one or more of the recesses.

2. The article of claim 1 wherein the two sloped surfaces include a first sloped surface and a second sloped surface, the first sloped surface defines a first acute angle with respect to the upper surface, the second sloped surface defines a second acute angle with respect to the upper surface that is a larger angle than the first acute angle.

3. The article of claim 2 wherein the first sloped surface defines a truncated conic section.

4. The article of claim 2 wherein the second sloped surface defines a truncated conic section.

5. The article of claim 1 wherein the tray is a formed sheet and the plurality of recesses are disposed along a major axis of the formed sheet.

6. The article of claim 1 wherein one or more of the edible substance is disposed in a sealed bag.

7. The article of claim 1 wherein the tray is formed from a single polymer sheet.

8. The article of claim 7 wherein the cover is a polymer film that is thinner than the formed sheet and is heat sealed or staked to the upper surface.

9. The article of claim 7 wherein the recesses are heat formed into the polymer sheet.

10. The article of claim 1 wherein the edible substance is a liquid or particulate substance.

11. An article for treating a rim of a beverage glass comprising:

a tray defining an upper surface with a plurality of recesses, two of the recesses extending downwardly from the upper surface, each of the two recesses is a recess defined by two sloped surfaces that intersect along an arcuate curve for accommodating an oblique angle of a widening rim beverage glass central axis with respect to the upper surface to accommodate a portion of the widening rim when treating the widening rim, the two sloped surfaces include a first sloped surface and a second sloped surface, the first sloped surface defining an acute angle with respect to the upper surface, the second sloped surface defining a greater angle with respect to the upper surface that is greater than the acute angle, the arcuate curve has an apex defining a lowest extent of the recess and two legs that intersect the upper surface;

an edible substance disposed in at least one of the recesses;

and a cover assembled to the upper surface to retain the edible substance within one or more of the recesses.

12. The article of claim 11 wherein the tray includes a hanger for hanging the tray substantially vertically with respect to a gravitational reference.

13. The article of claim 11 wherein the greater angle is a right angle relative to the upper surface.

14. The article of claim 13 wherein the first sloped surface is a curved surface.

15. The article of claim 13 wherein the first sloped surface defines a truncated conic section.

16. The article of claim 13 wherein the second sloped surface defines a truncated conic section.

17. An article for treating the rim of a beverage glass comprising:

a tray defining an upper surface with a plurality of recesses extending downwardly from the upper surface and arranged along a major axis of the tray, the plurality of recesses including at least a first recess, a second recess, and a third recess, the recesses varied in geometry to accommodate varied orientations of the beverage glass when treating the rim;

an edible liquid substance disposed in a first one of the recesses;

an edible particulate substance disposed in a second one of the recesses; and a cover assembled to the upper surface to retain the edible substances within one or more of the recesses, the first and second recesses include two recesses that individually are defined by two sloped surfaces that intersect along an arcuate curve, the two sloped surfaces include a first sloped surface and a second sloped surface, the first sloped surface defining an acute angle with respect to the upper surface, the second sloped surface defining an angle with respect to the upper surface that is greater than the acute angle, the arcuate curve has an apex defining a lowest extent of the recess and two legs that intersect the upper surface, the third recess is an annular recess having a planar bottom;

the third recess for accommodating a beverage glass rim having a rim diameter to fit within the annular recess, the first and second recesses to accommodate a beverage glass rim having a widened rim diameter that does not fit within the annular recess.

18. The article of claim 17 wherein plurality of recesses are arranged along a major axis of the tray, the second recess occupying a greater lateral distance along the major axis than the first recess.

* * * * *